US011591181B2

(12) United States Patent
Harmon et al.

(10) Patent No.: US 11,591,181 B2
(45) **Date of Patent: *Feb. 28, 2023**

(54) REEL TRANSPORT, STAND AND PAYOFF DEVICE

(71) Applicants: Jeffrey R. Harmon, Surprise, AZ (US); Bradley C. Phillips, Scottsdale, AZ (US); Tyson Gentz, Glendale, AZ (US)

(72) Inventors: Jeffrey R. Harmon, Surprise, AZ (US); Bradley C. Phillips, Scottsdale, AZ (US); Tyson Gentz, Glendale, AZ (US)

(73) Assignee: ESA FABRICATION, LLC, Phoenix, AZ (US)

( * ) Notice: Subject to any disclaimer, the term of this patent is extended or adjusted under 35 U.S.C. 154(b) by 177 days.

This patent is subject to a terminal disclaimer.

(21) Appl. No.: 17/087,018

(22) Filed: Nov. 2, 2020

(65) Prior Publication Data

US 2021/0047143 A1 Feb. 18, 2021
US 2022/0380171 A9 Dec. 1, 2022

Related U.S. Application Data

(62) Division of application No. 16/167,997, filed on Oct. 23, 2018, now Pat. No. 10,934,129.

(60) Provisional application No. 62/575,760, filed on Oct. 23, 2017.

(51) Int. Cl.
*B65H 75/40* (2006.01)
*B65H 75/44* (2006.01)

(52) U.S. Cl.
CPC ..... *B65H 75/403* (2013.01); *B65H 75/4465* (2013.01); *B65H 2406/40* (2013.01)

(58) Field of Classification Search
CPC ..... B65H 75/403; B65H 75/441; B65H 75/4465; B65H 49/38; B65H 49/321; B65H 2406/40
See application file for complete search history.

(56) References Cited

U.S. PATENT DOCUMENTS 2,452,481 A * 10/1948 Morehead ..... B65H 49/24 414/428
3,944,094 A 3/1976 Compton
4,447,012 A * 5/1984 Woodruff ..... B65H 16/06 414/458
4,711,407 A 12/1987 Boon
2017/0144685 A1 5/2017 Mcvay
(Continued)

*Primary Examiner* — Sang K Kim
(74) *Attorney, Agent, or Firm* — Schmeiser, Olsen & Watts LLP

(57) ABSTRACT

A reel transport, stand and payoff device is provided, which operates to maneuver and jack up a reel for payoff. The reel device may include two reel mechanisms coupled together with a first support member and a second support member. Each reel mechanism includes a wheel housing and a wheel coupled to a central portion of the wheel housing. Each reel mechanism includes an arm coupled on an end to a central portion of the wheel housing. An actuator is coupled between the wheel housing and the arm to raise or lower the arm. The reel device may include at least one caster to help support and stabilize the reel device. A shaft is inserted through a reel and coupled on each end to an arm by a bracket. A method of use of a reel transport, stand and payoff device is also disclosed.

8 Claims, 20 Drawing Sheets

(56) References Cited

U.S. PATENT DOCUMENTS

| | | | |
|---|---|---|---|
| 2018/0155158 | A1 | 6/2018 | Levey |
| 2018/0170706 | A1 | 6/2018 | Grabowski et al. |

* cited by examiner

REEL TRANSPORT, STAND AND PAYOFF DEVICE

CROSS REFERENCE TO RELATED APPLICATION [S]

This application is a divisional of U.S. patent application entitled "REEL TRANSPORT, STAND AND PAYOFF DEVICE," Ser. No. 16/167,997, filed Oct. 23, 2018, which claims priority to the earlier U.S. Provisional Patent Application entitled "REEL TRANSPORT, STAND AND PAYOFF DEVICE," Ser. No. 65/575,760, filed Oct. 23, 2017, the disclosures of which are hereby incorporated entirely herein by reference.

BACKGROUND OF THE INVENTION

Technical Field

This invention relates generally to stand and payoff systems for cable or wire reels and more particularly to a reel transport, stand and payoff device that operates to maneuver and lift up a reel for payoff.

State of the Art

Conventionally, reels of cable or wire are utilized on construction worksites and other uses. Typically, a hand truck, fork lift or other transport device is used to transport or maneuver a reel around a location. It is then loaded onto a stand or other payoff system in order for payoff or unwinding of the cable or wire. This is time consuming and requires additional manpower to get the reel into a position for use. These systems are lacking in efficiency for transport, storage, and payoff of the reel of cable or wire.

SUMMARY OF THE INVENTION

The present invention relates to a reel transport, stand and payoff device that operates to maneuver and jack up a reel for payoff or pay on. The device may be used for any material stored in such a way that allows it to be wound or unwound on a reel.

An embodiment of a reel device comprises: two reel mechanisms coupled together with a first support member and a second support member, each reel mechanism comprising: a wheel housing; a wheel coupled to a central portion of the wheel housing; an arm coupled on an end to a central portion of the wheel housing; an actuator operably coupled between the wheel housing and the arm; and a first caster coupled to an end of the wheel housing; a caster coupled to a center portion of the first support member; and a shaft coupled between an end of each arm of the reel mechanisms.

Embodiments of a reel device may further comprise a brake mechanism for preventing rotation of the wheel while the reel device is not in use. The brake mechanism may be disengaged by a user pushing or pulling on a handle, the handle being hingedly coupled to the arms by a pair of handle arms, such that rotation of the handle draws a brake cable that operates to disengage the brake mechanism while the reel device is in use. The user may thereby push or pull the reel device for transport of a reel within a warehouse or another location.

A method of use of a reel device is also disclosed, comprising the steps of extending a shaft of the reel device through an axle of the reel; coupling the shaft between arms of reel mechanisms of the reel device; moving the arms from a retracted position to a partially extended position, wherein the partially extended position lifts the reel off of a ground surface; transporting the reel by use of wheels of the reel device; and moving the arms to an extended position for reel payoff.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
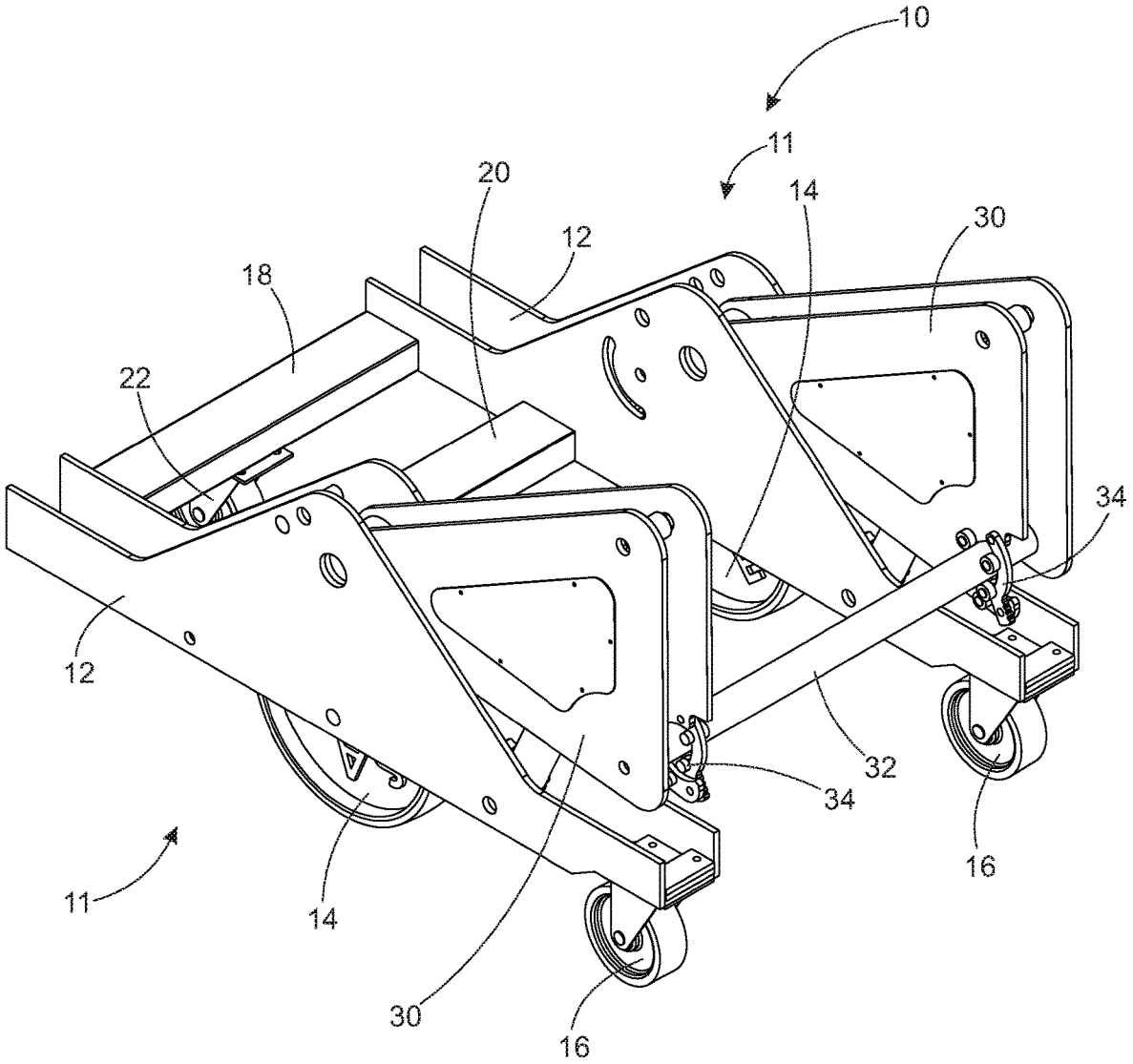
FIG. 1 is a top perspective view of a reel device in a retracted position in accordance with an embodiment.
Figure 2:
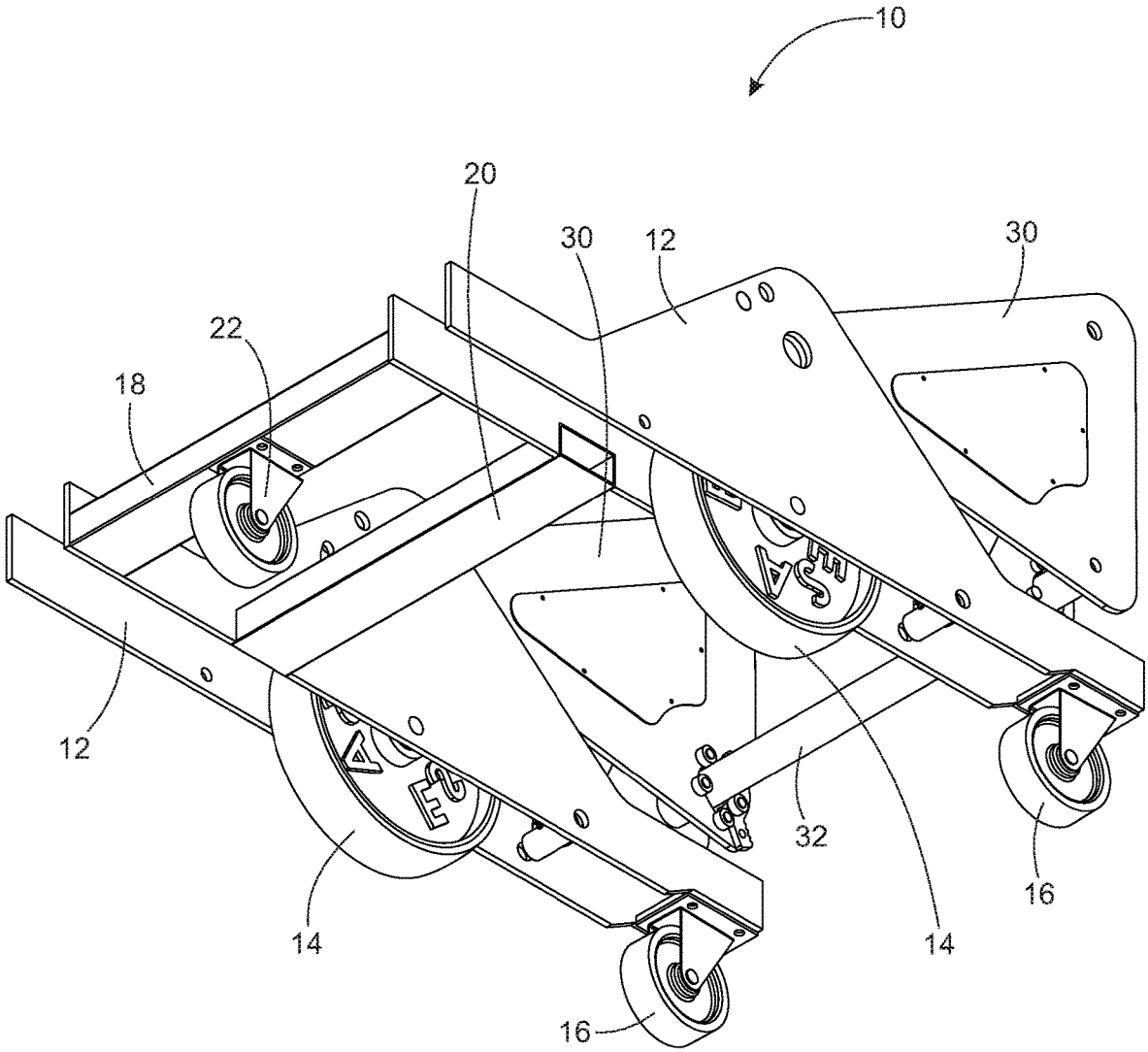
FIG. 2 is a bottom perspective view of a reel device in a retracted position in accordance with an embodiment.
Figure 3:
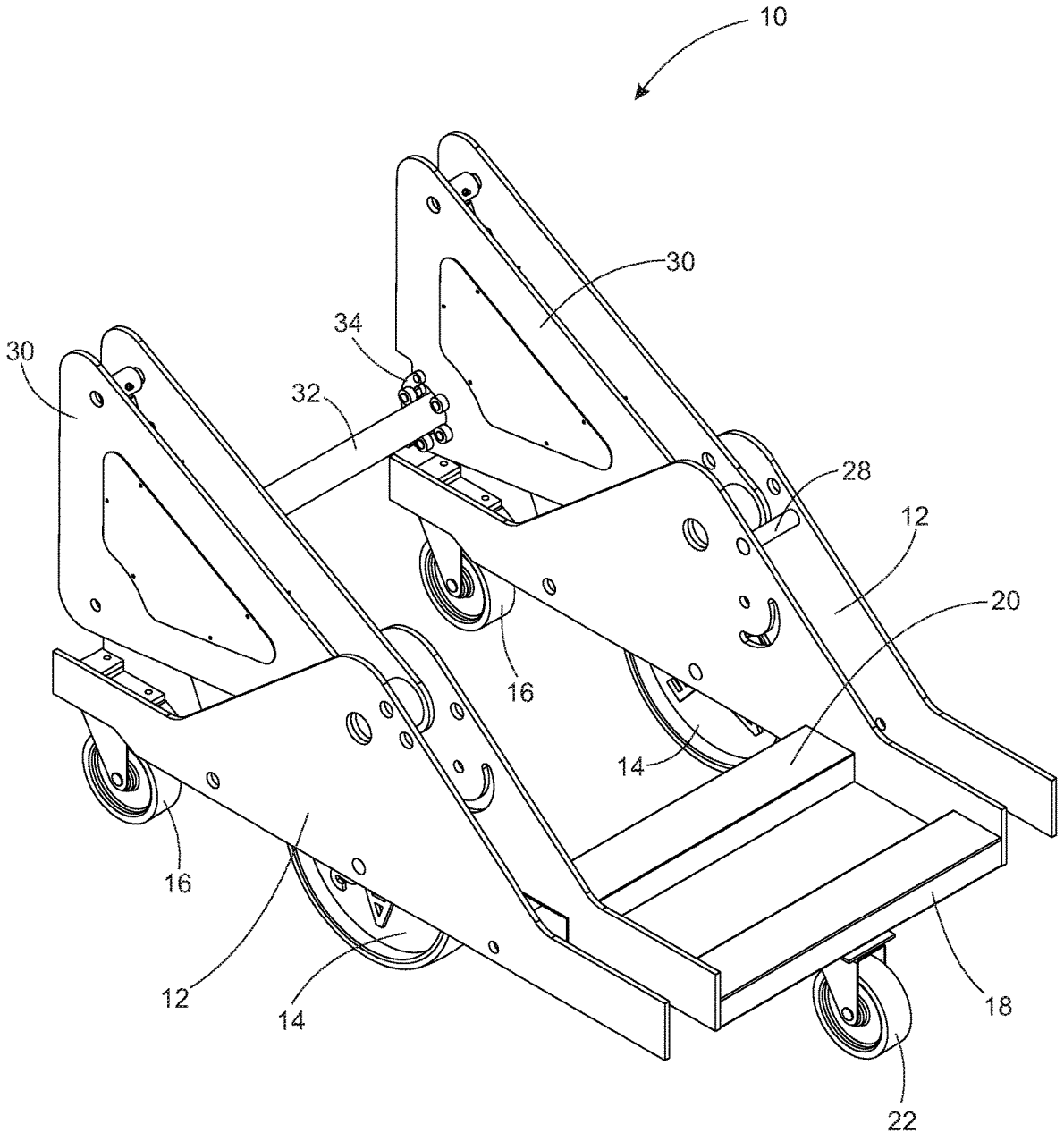
FIG. 3 is another top perspective view of a reel device in a retracted position in accordance with an embodiment.
Figure 4:
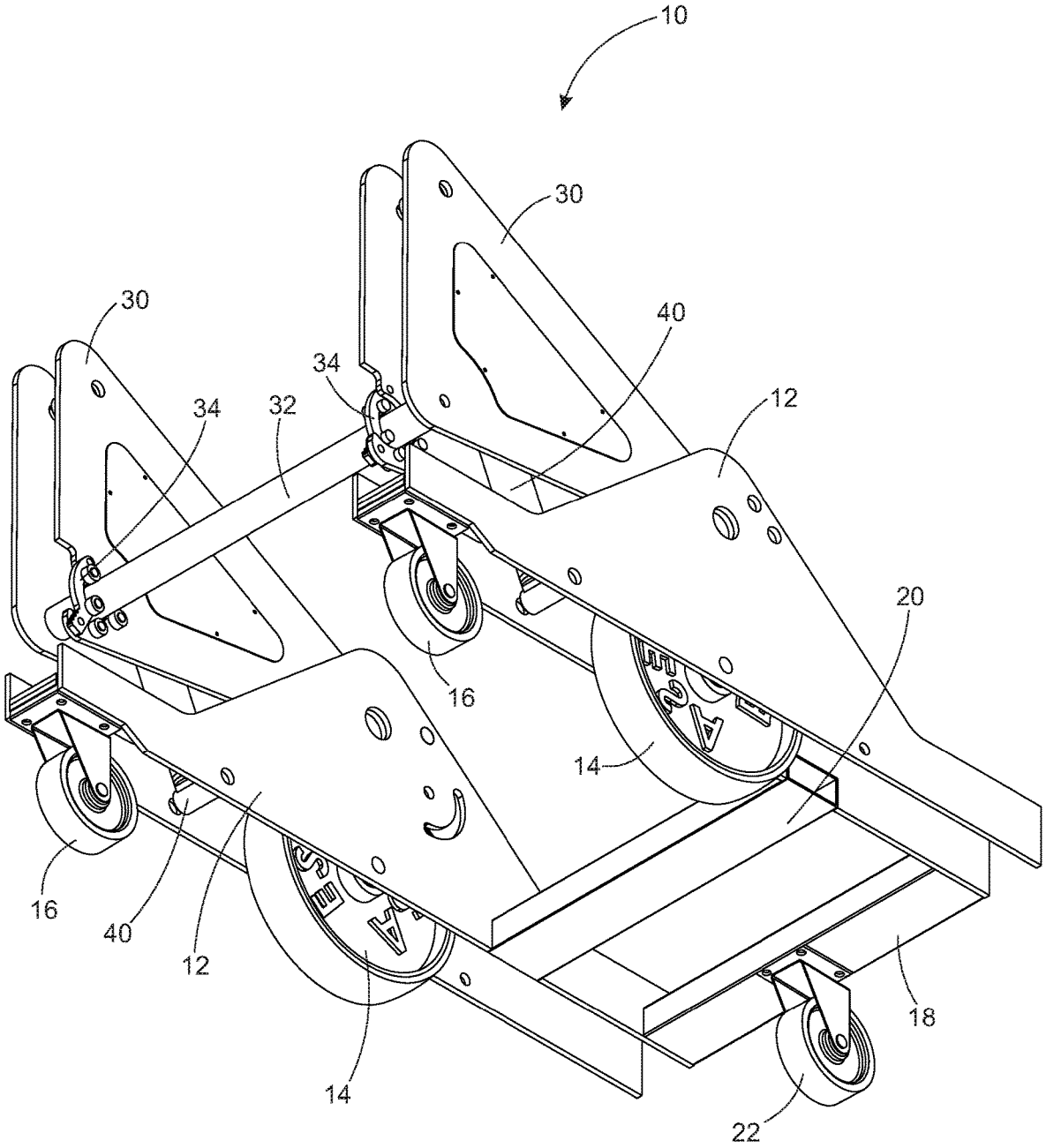
FIG. 4 is another bottom perspective view of a reel device in a retracted position in accordance with an embodiment.
Figure 5:
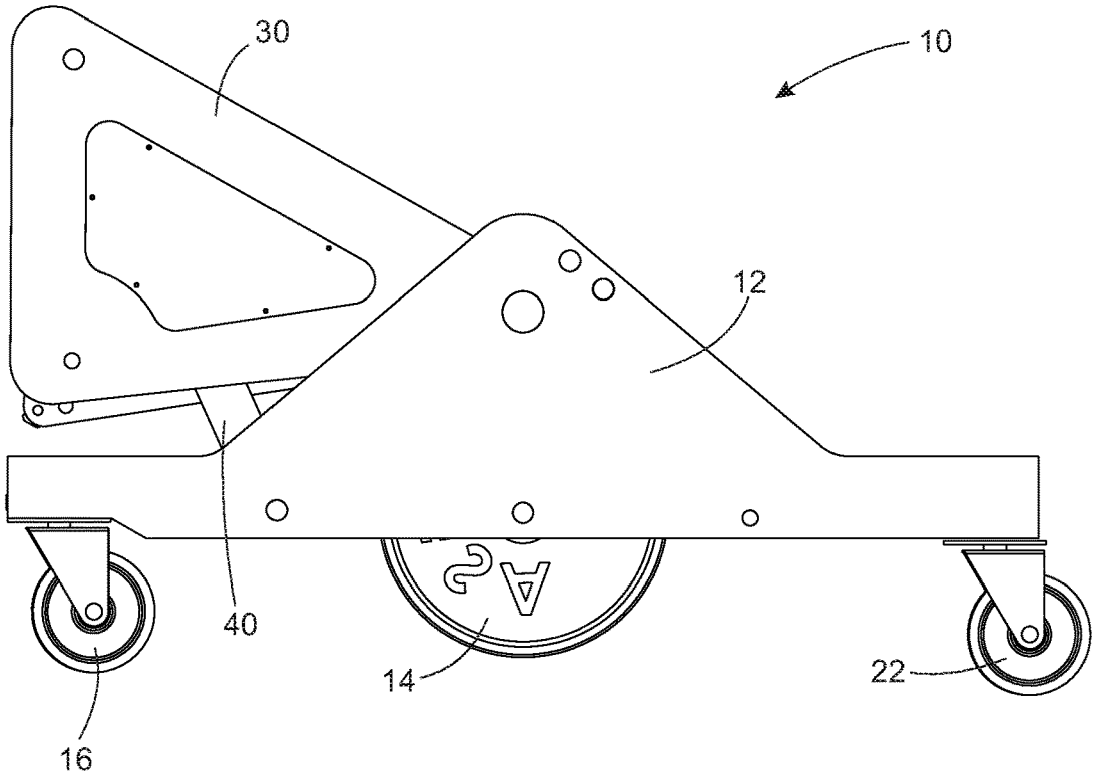
FIG. 5 is a side view of a reel device in a retracted position in accordance with an embodiment.
Figure 6:
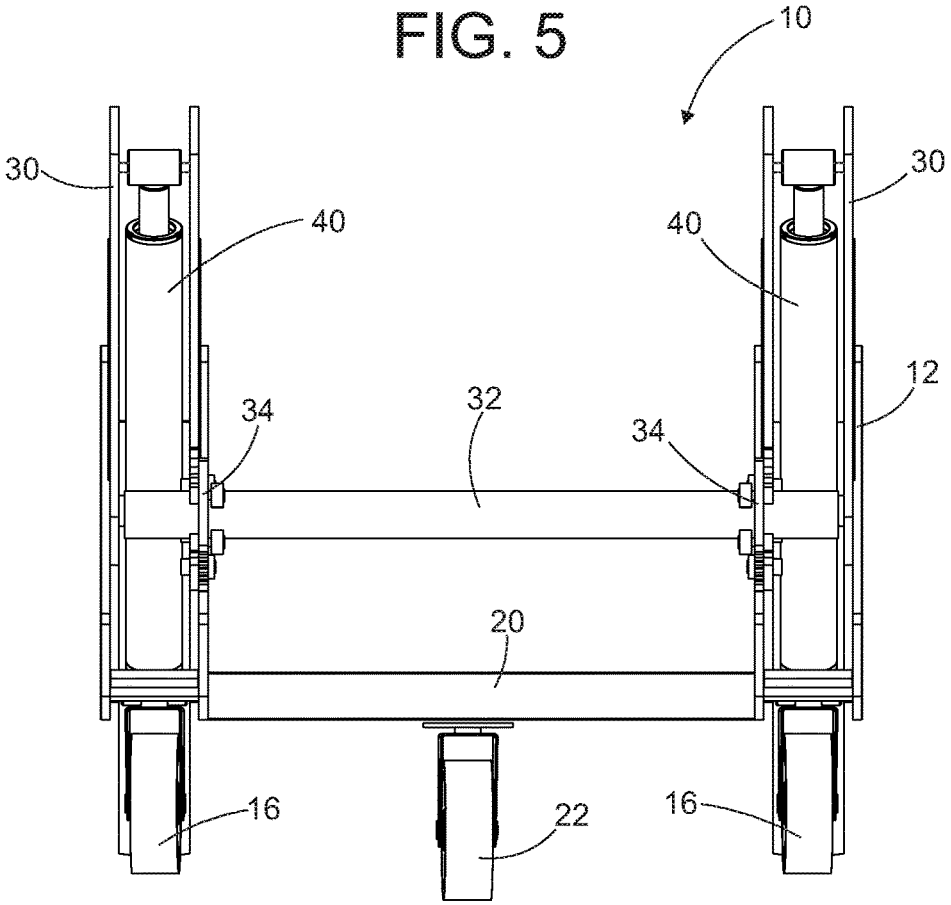
FIG. 6 is a front view of a reel device in a retracted position in accordance with an embodiment.
Figure 7:
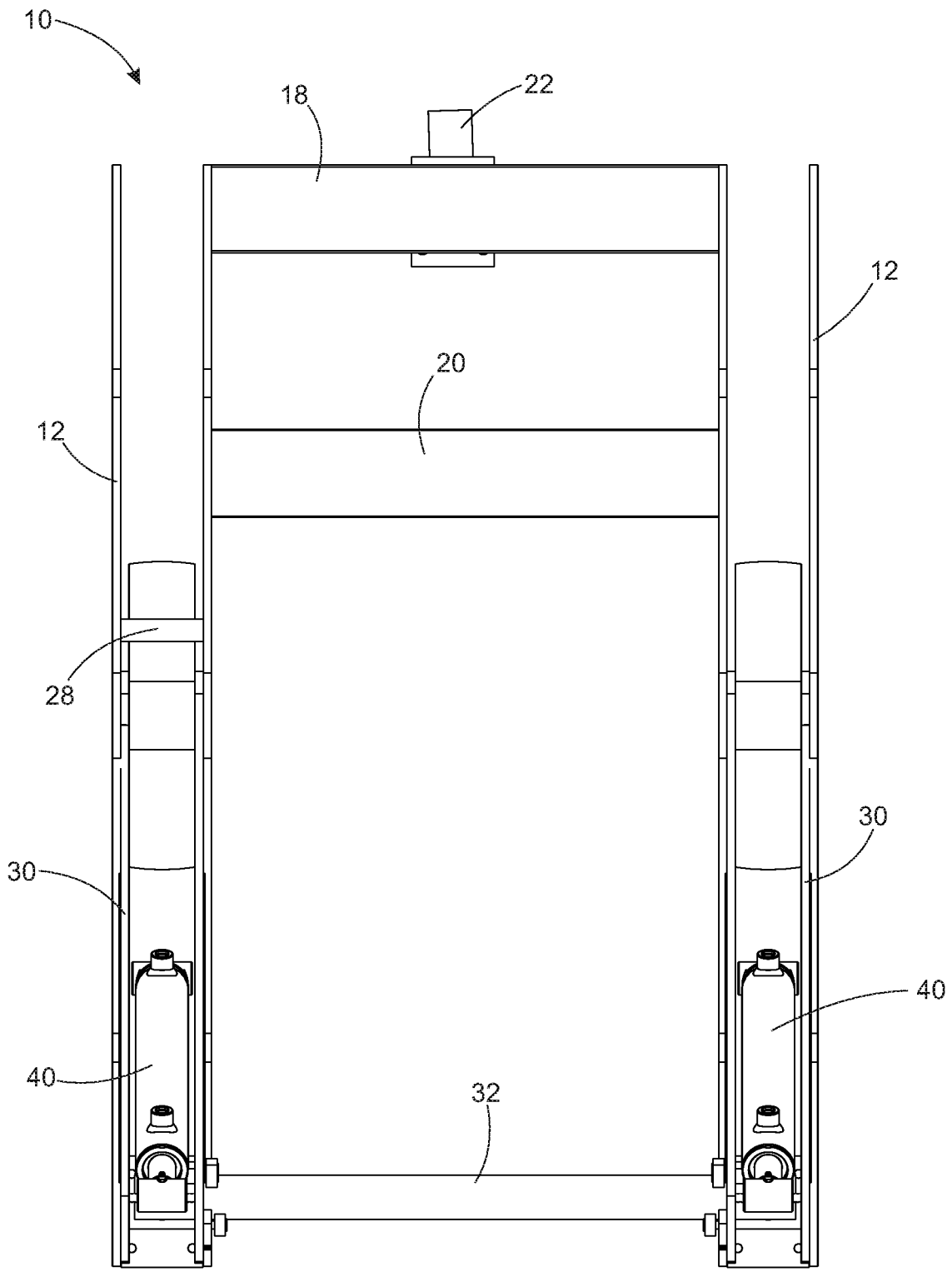
FIG. 7 is a top view of a reel device in a retracted position in accordance with an embodiment.
Figure 8:
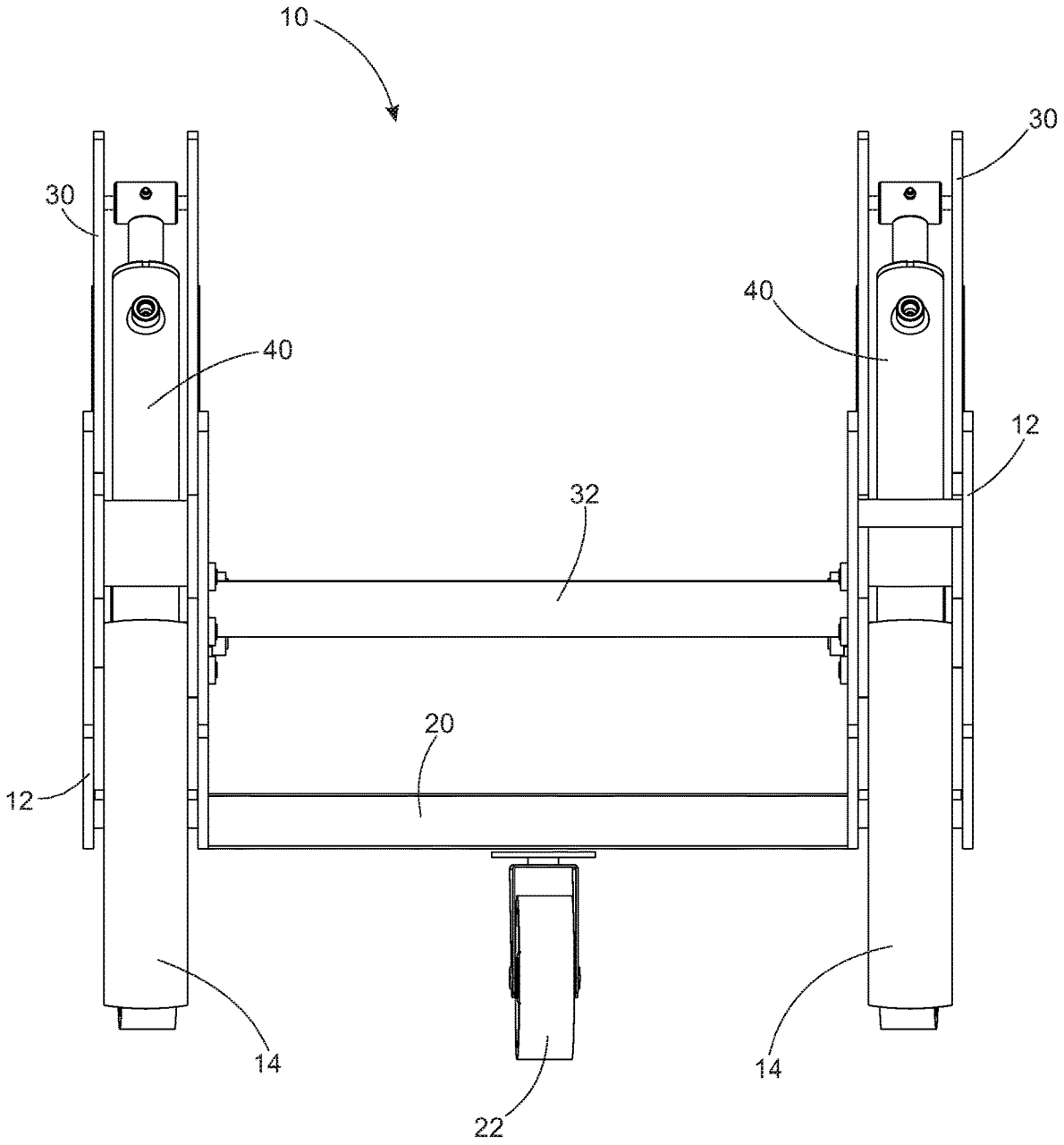
FIG. 8 is a rear view of a reel device in a retracted position in accordance with an embodiment.
Figure 9:
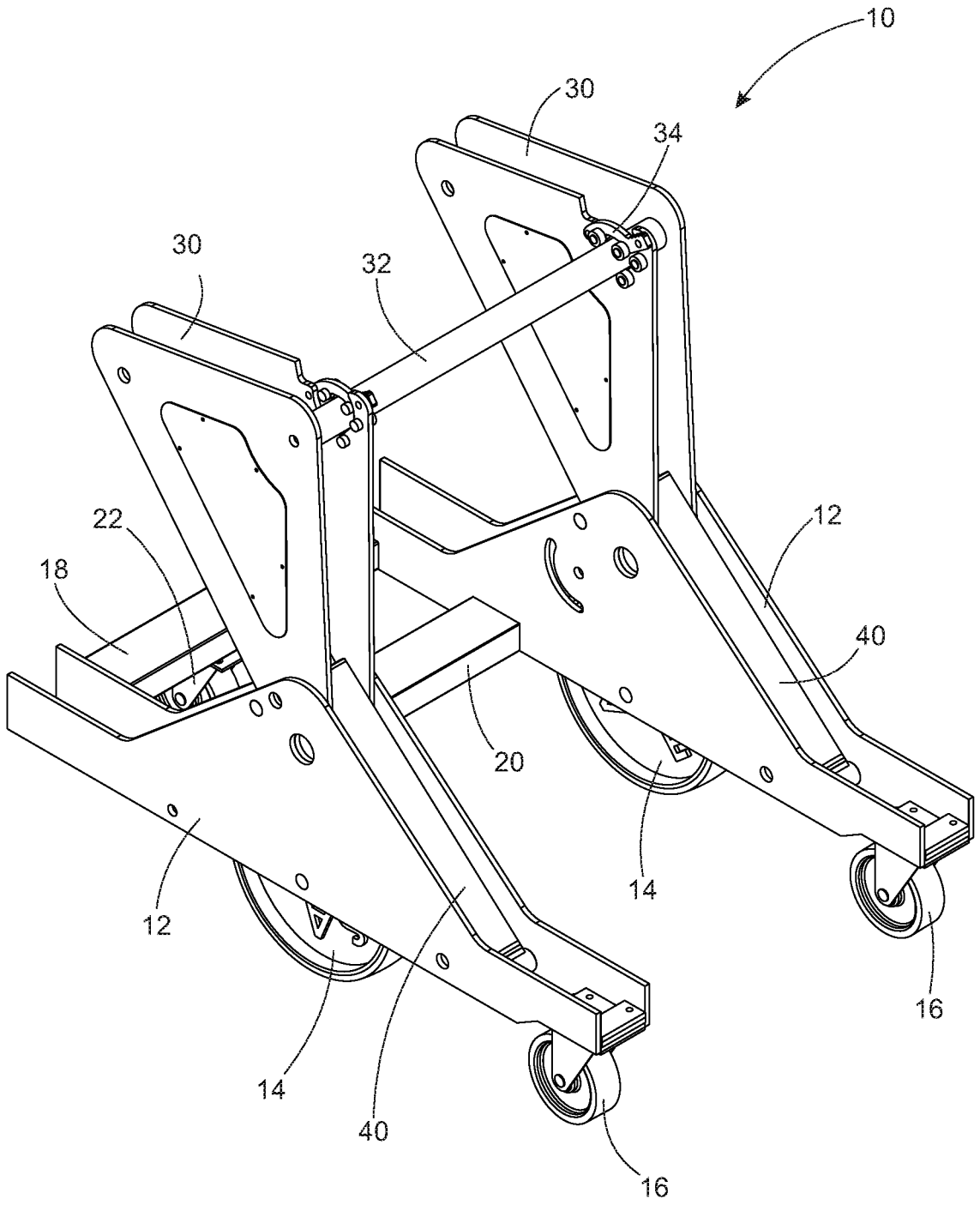
FIG. 9 is a perspective view of a reel device in an extended position in accordance with an embodiment.
Figure 10:
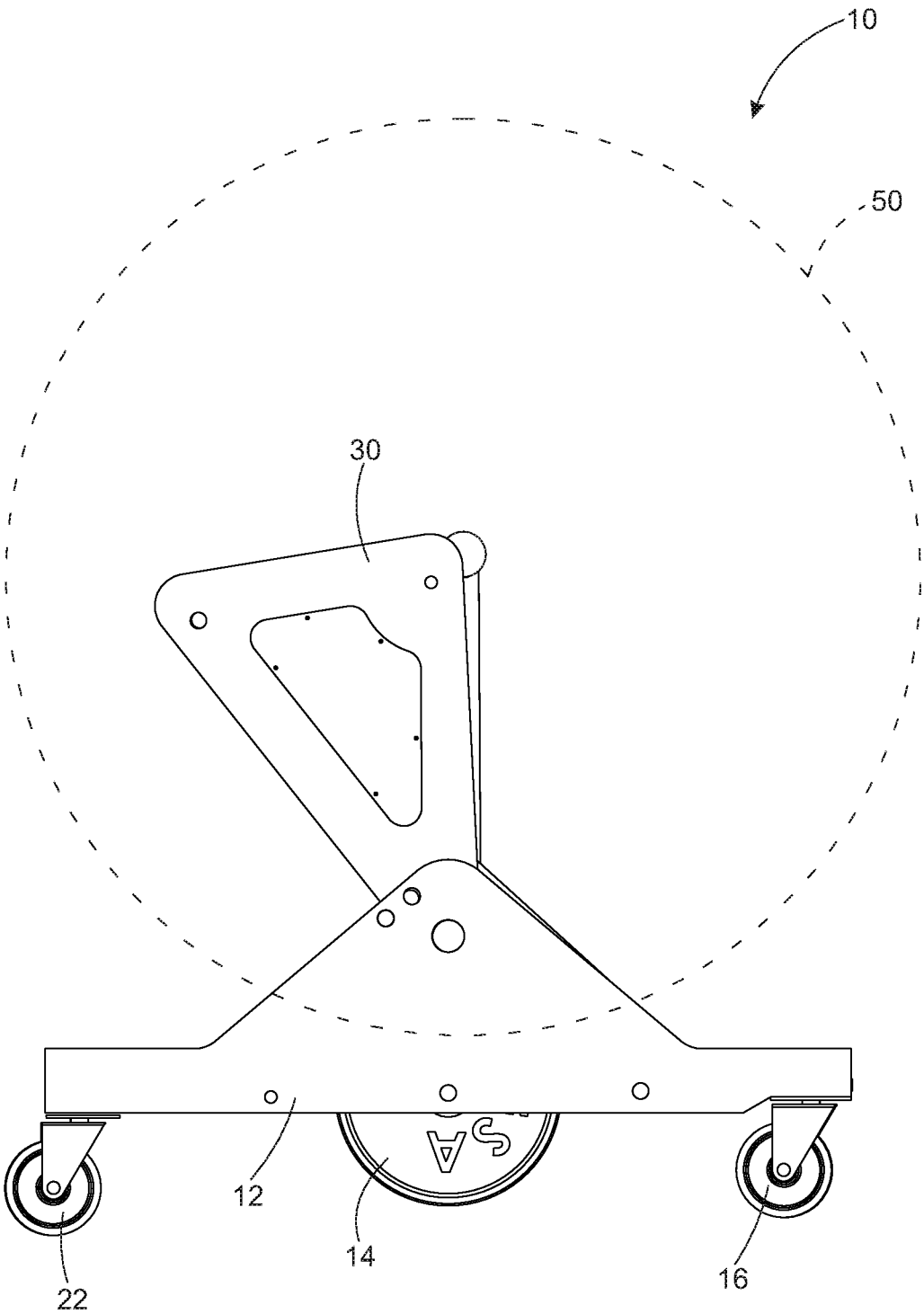
FIG. 10 is a side view of a reel device in an extended position with a reel coupled thereto in accordance with an embodiment.
Figure 11:
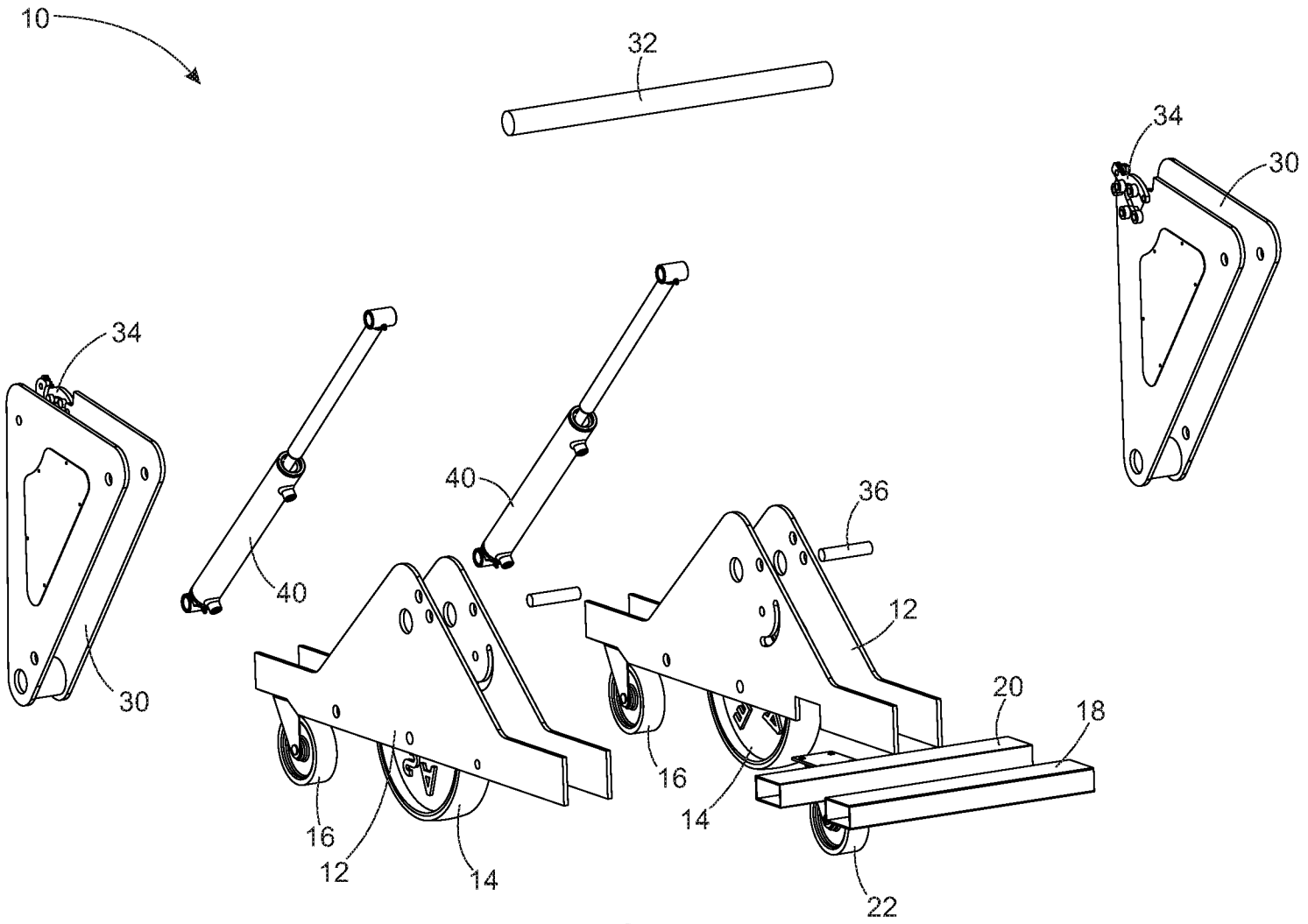
FIG. 11 is an exploded view of a reel device in an extended position in accordance with an embodiment.
Figure 12:
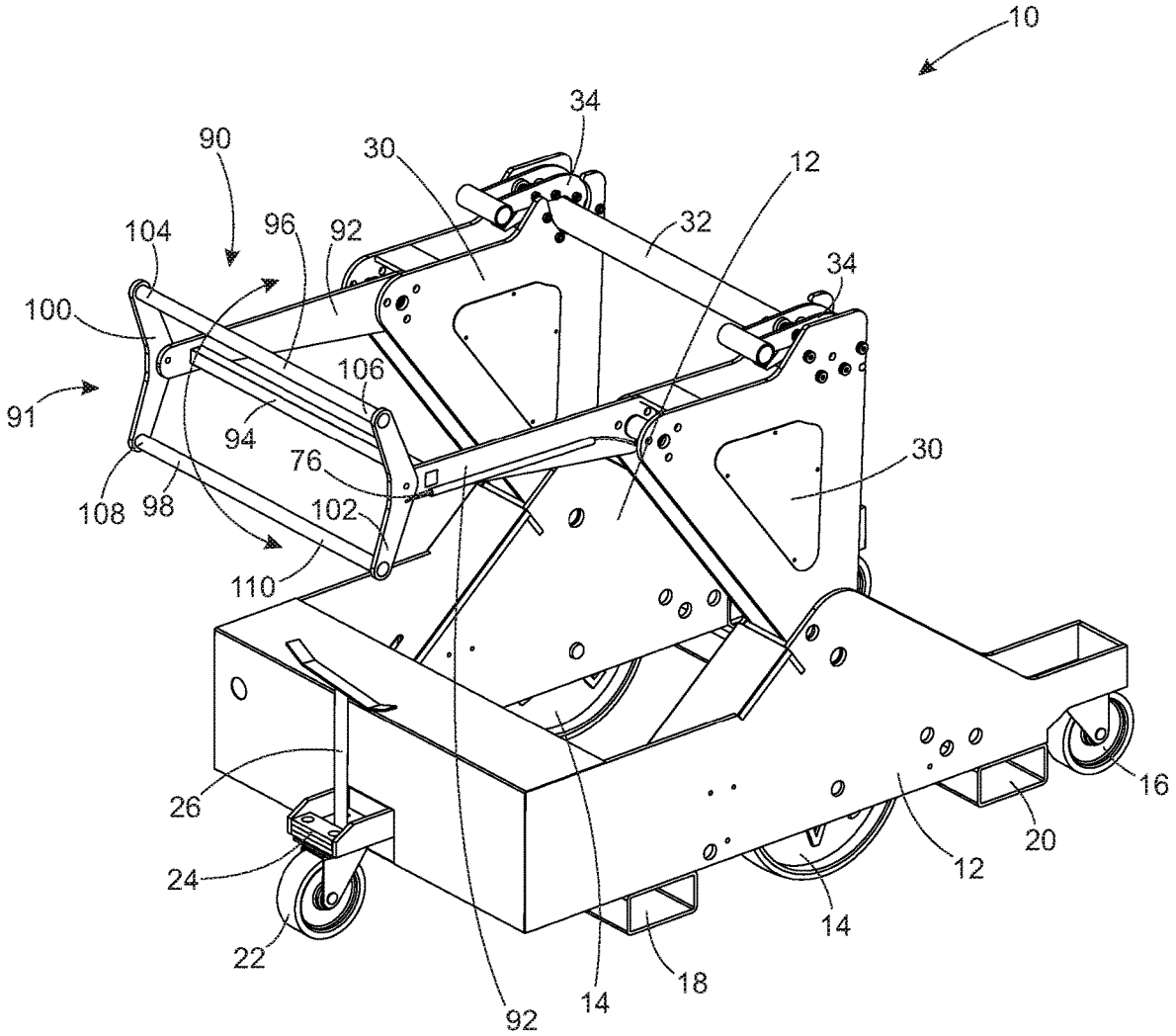
FIG. 12 is a perspective view of a reel device in accordance with an embodiment.
Figure 13:
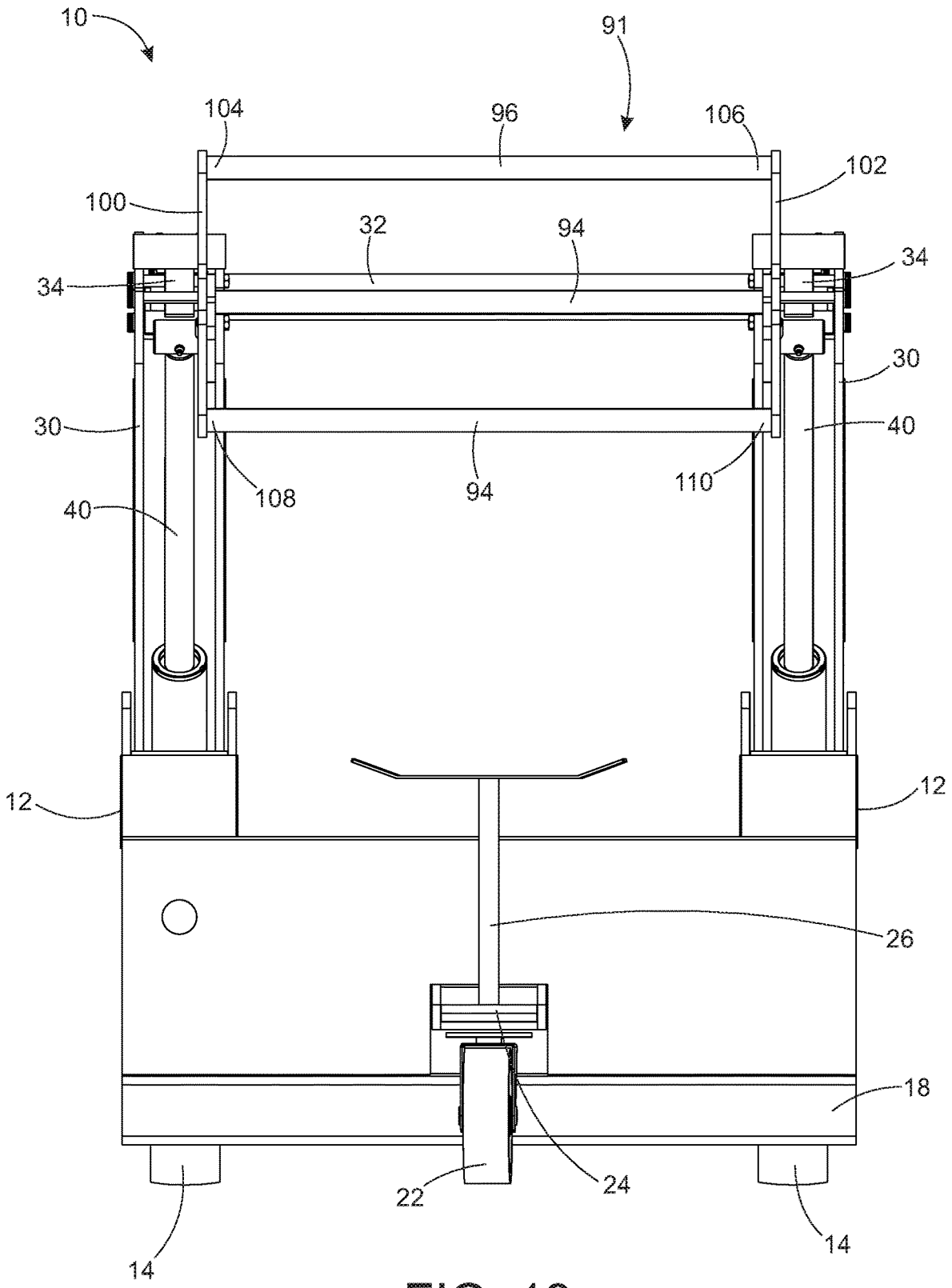
FIG. 13 is a rear view of a reel device in accordance with an embodiment.
Figure 14:
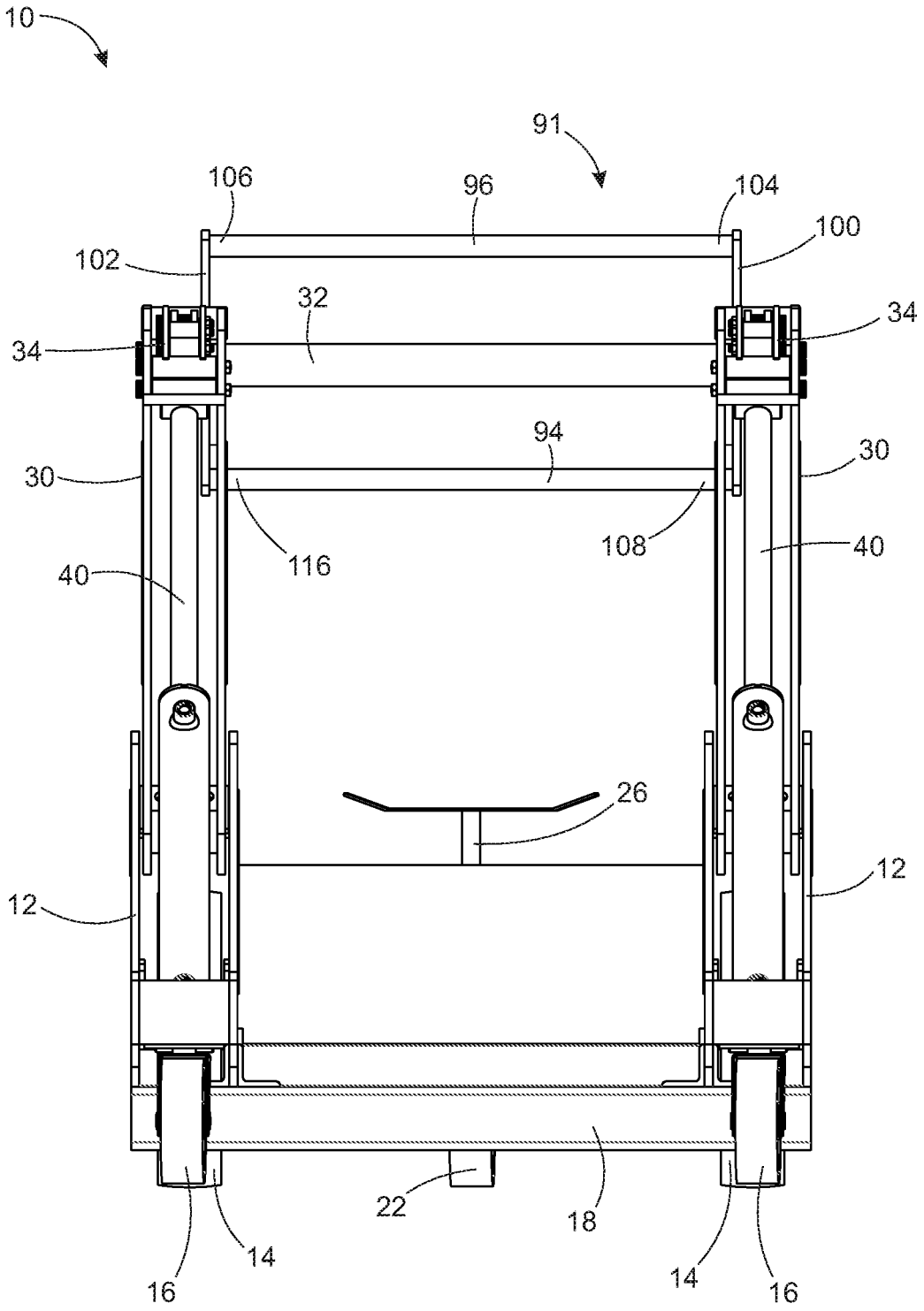
FIG. 14 is a front view of a reel device in accordance with an embodiment.
Figure 15:
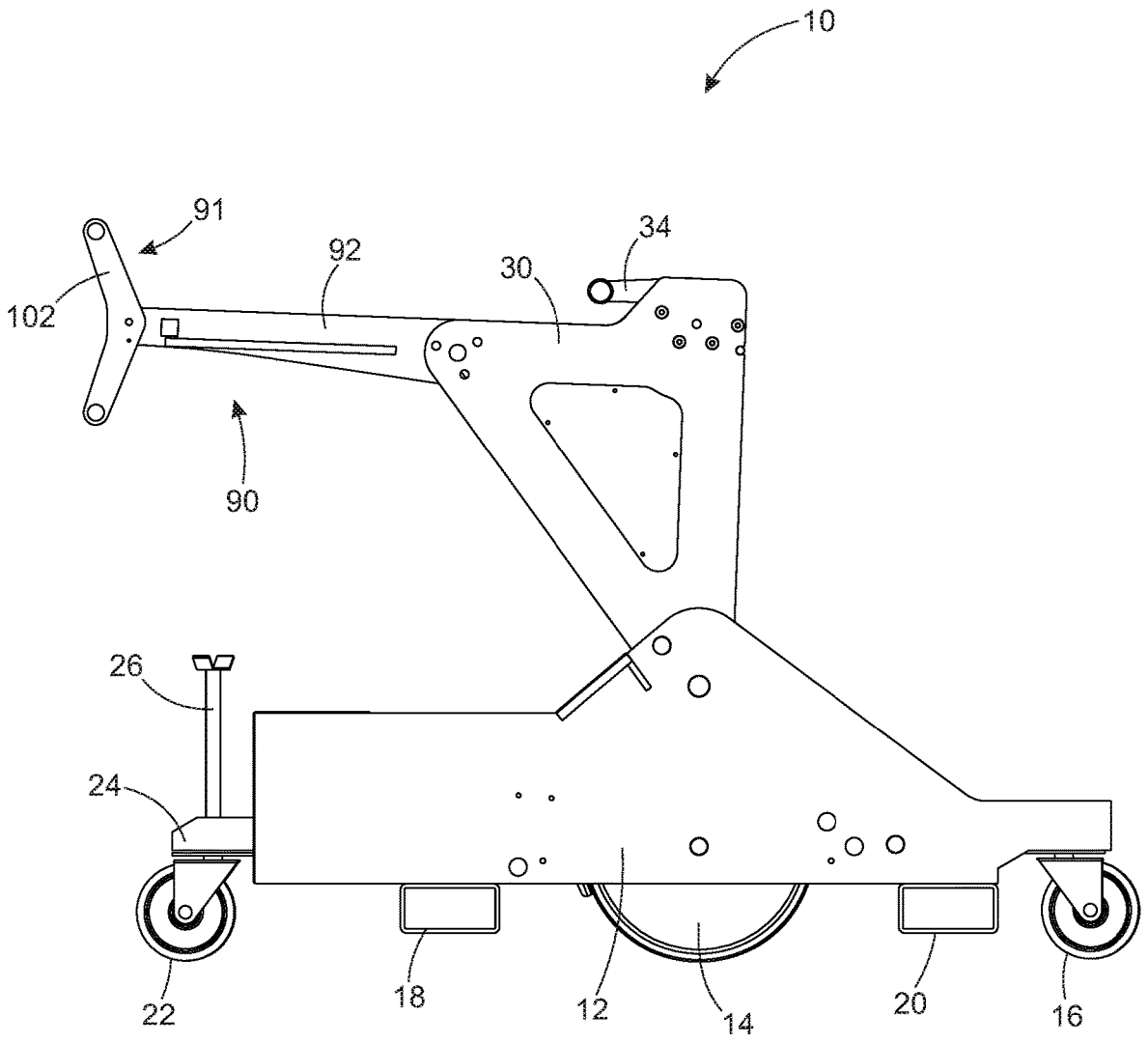
FIG. 15 is a side view of a reel device in a retracted position in accordance with an embodiment.
Figure 16:
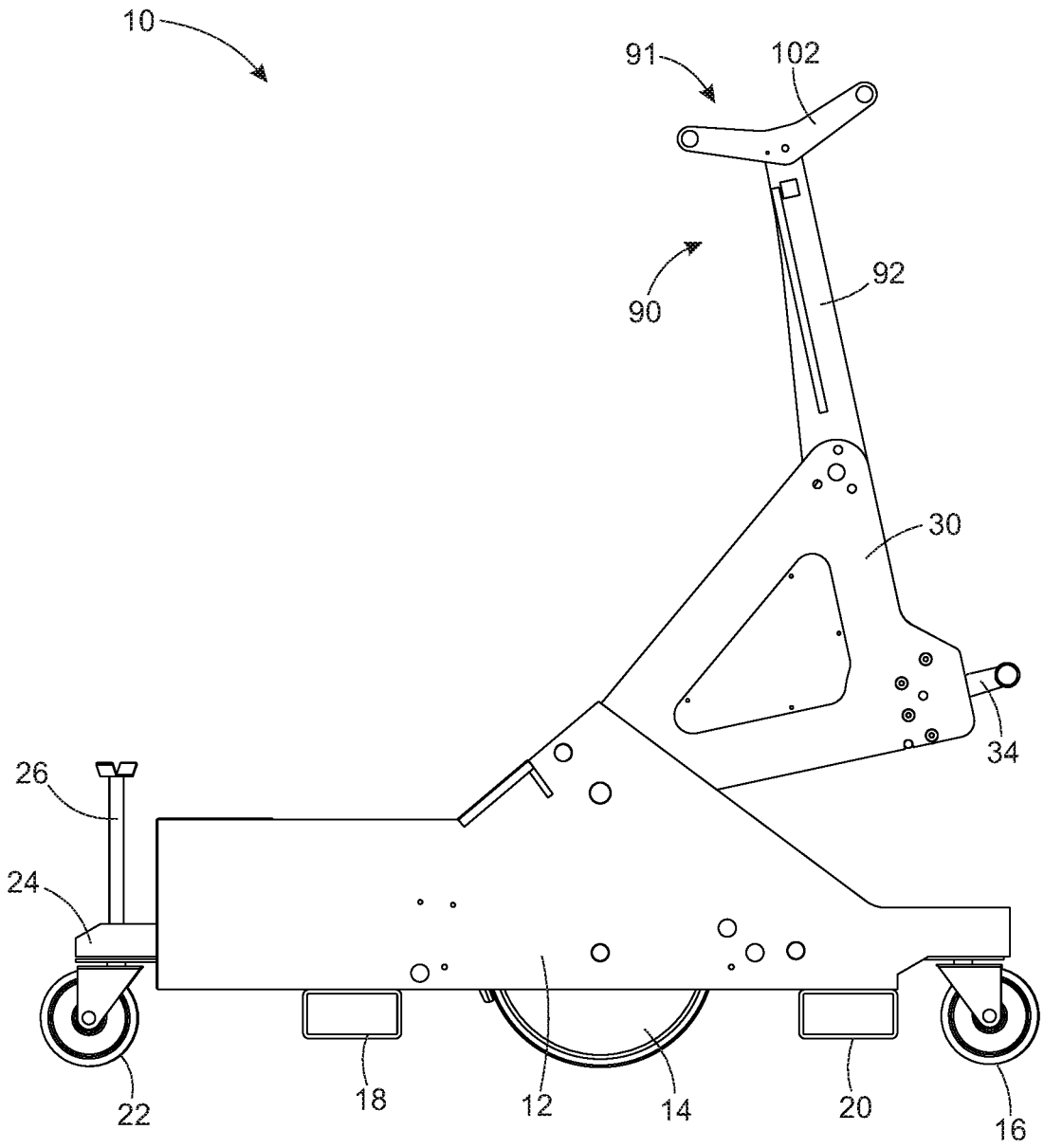
FIG. 16 is a side view of a reel device an extended position in accordance with an embodiment.

As discussed above, embodiments of the present invention relate to a reel transport, stand and payoff device that operates to maneuver and jack up a reel for payoff.

Referring to the drawings, FIGS. 1-11 depict an embodiment of a reel transport, stand and payoff device 10, referred to as a reel device 10. The reel device 10 includes two reel mechanisms 11. Each reel mechanism 11 includes a wheel housing 12 and a wheel 14 coupled to the wheel housing. In embodiments, the wheel housing may include two plates with a wheel 14 operably coupled between the plates. The reel mechanism 11 further includes a first caster 16 for steering and support for transport and loading a reel onto the reel device 10.

The reel mechanism 11 further includes an arm 30 rotatably coupled to the wheel housing 12 on one end of the arm 30. The reel mechanism 11 also includes an actuator 40 operably coupled between the wheel housing 12 and the arm 30, wherein the actuator 40 operates to move the arm 30 between a retracted position with the arm rotated close to the wheel housing 12 with the actuator 40 in a fully retracted position (See FIGS. 1-8) and an extended position with the arm rotated away from the wheel housing 12 with the actuator 40 extended (See FIGS. 9-10). In the fully retracted position, the shaft 32 is located above and adjacent to the first casters 16. This allows the casters 16 to provide support when the reel 50 is loaded on the reel device by coupling the shaft to the arm 30. In the fully extended position, the shaft 32 may be located above an axis of rotation of the arms 30.

Each arm 30 may be formed of two plates coupled together and each arm 30 may be coupled between the plates forming the wheel housing 12. Additionally, the actuator 40 may be coupled between the plates forming the wheel housing 12 on one end of the actuator 40 and coupled between the plates forming the arm 30 on the opposing end of the actuator 40.

The two reel mechanisms 11 may be coupled together with a first support member 18 and a second support member 20. In some embodiments, a second caster 22 is coupled to the first support member 18, wherein the second caster may be used for support and steering when a reel 50 is coupled to the reel device 10. The reel device 10 may further include a shaft 32 that is coupled between an end of the arms 30 of the two reel mechanisms 11. The shaft 32 may be coupled to the arm 30 by use of brackets 34. The shaft 32 operates to extend through an axle of a reel 50. The shaft 30 may be removably coupled to the arm 30 with a bracket 34.

In embodiments, the height of second caster 22 may adjustable for more or less stability of the reel device 10. For example, second caster 22 may be operably coupled to a mounting bracket 24 with a threaded aperture therethrough, having an adjustment handle 26 threaded therethrough that engages second caster 22, such that a user may adjust the height of second caster 22 by rotating the adjustment handle 26. When the second caster 22 is adjusted upward, this allows the reel device 10 to teeter on wheels 14, thus facilitating maneuverability of the reel device over uneven surfaces. For more stability, second caster 22 may be adjusted downward such that all casters 16 and 22 and wheels 14 of the reel device are in contact with the floor. Although, in embodiments, the height of second caster 22 may be adjusted by rotating an adjustment handle 26 that operably engages second caster 22, as described, this is not intended to be limiting. The height of second caster 22 may be adjustable, in some embodiments, by any other means known by a person of skill in the art. Furthermore, any of casters 16 may be adjustable in height, in some embodiments, by any means known by a person of skill in the art.

Each reel mechanism 11 may further include a stop member 28. The stop member 28 operates to stop the rotation of the arm 30 and marks the position of the arm 30 in the fully extended position, or in other words, sets the bound of the range of motion of the arm 30 as it extends from the wheel housing 12.

Figure 17:
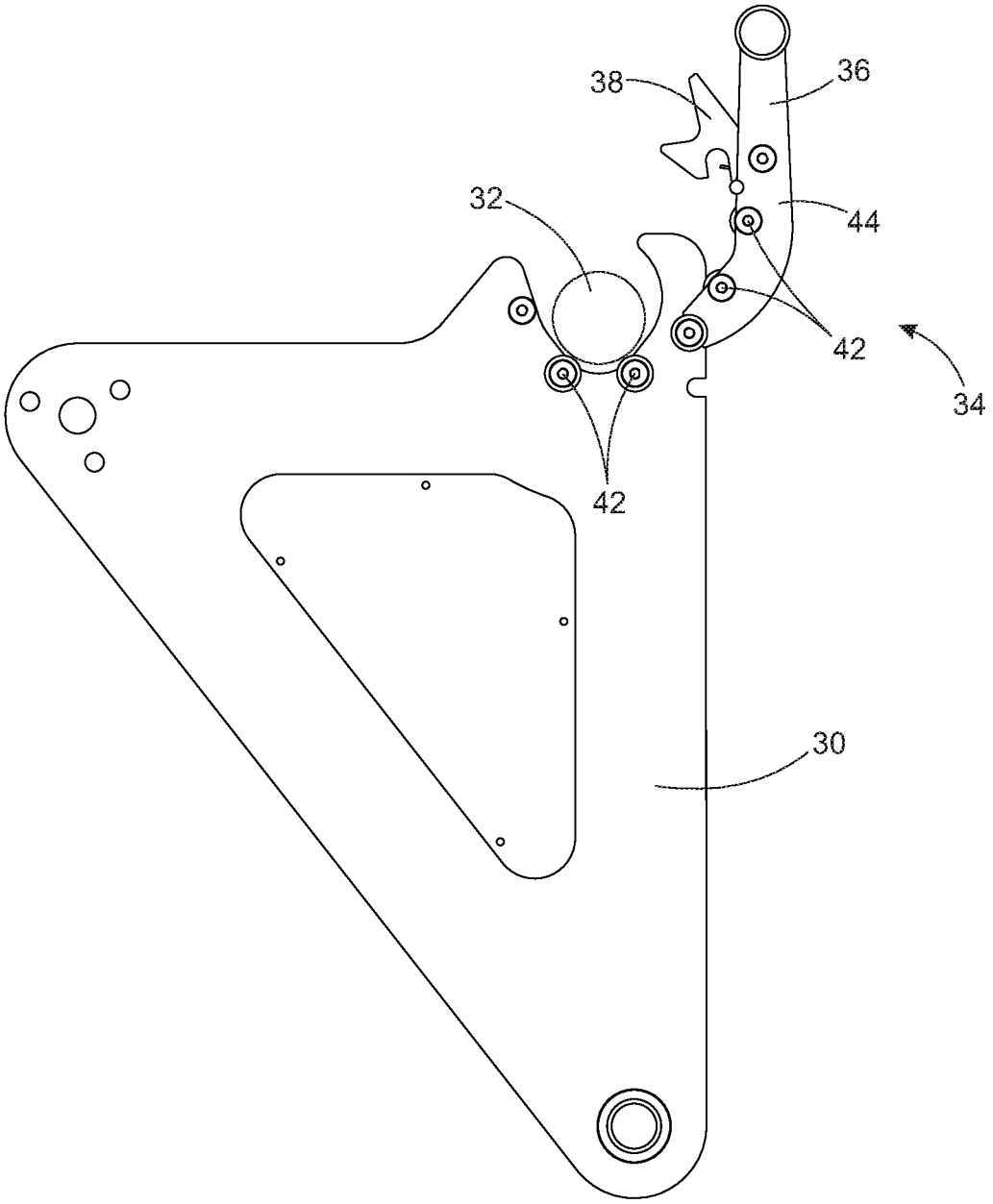
FIG. 17 is a side view of a bracket having the clasp thereof in an open position, wherein a plate of the arm has been hidden to show the bracket, in accordance with an embodiment.
Figure 18:
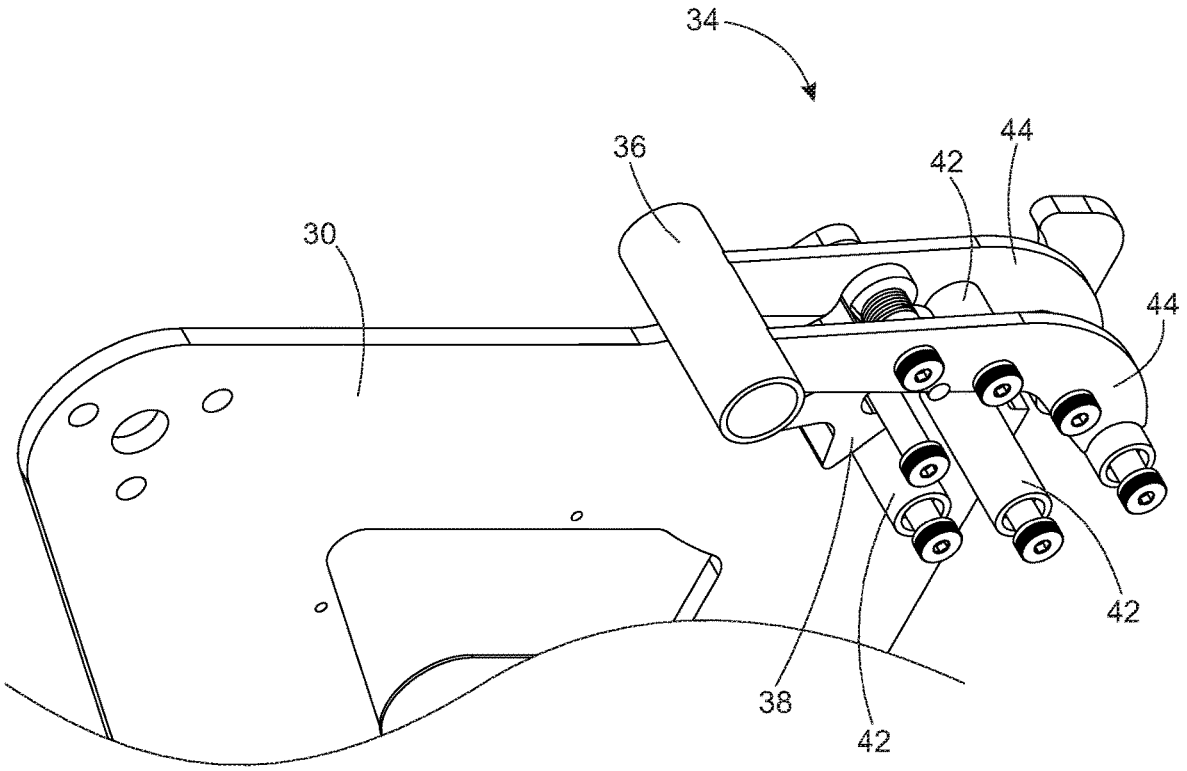
FIG. 18 is a perspective view of a bracket having the clasp thereof in a closed position, wherein a plate of the arm has been hidden to show the bracket, in accordance with an embodiment.
Figure 19:
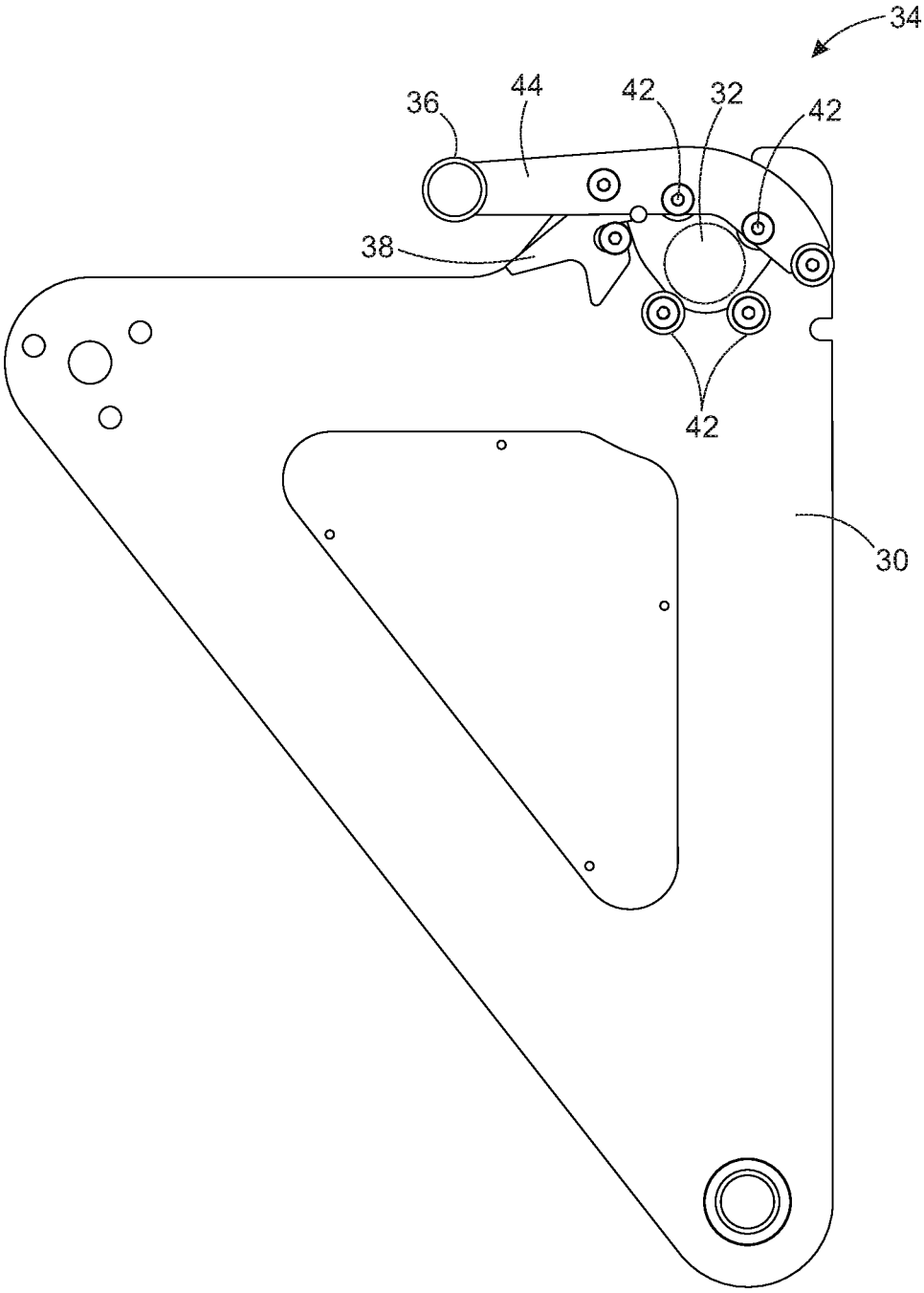
FIG. 19 is a side view of a bracket having the clasp thereof in a closed position, wherein a plate of the arm has been hidden to show the bracket, in accordance with an embodiment.

In embodiments, as shown in FIGS. 17-19, bracket 34 may comprise a clasp 36 hingedly coupled to the arm 30, such that the clasp 36 extends outward from the arm 30 in an open position, as shown in FIG. 17, and a user may rotate the clasp upward and inward to the arm 30 to close the clasp to a closed position, as shown in FIGS. 18-19. The clasp 36 may be configured with a spring-loaded latch 38 for locking the clasp 36 into the closed position. The clasp 36 may be unlocked by a user by grasping and lifting the spring-loaded latch 38 to open the clasp 36. A plurality of linear bearings 42 may be coupled between the plates of the arm 30 for bearing the load of the shaft 32. The clasp 36 may be formed of two plates 44 coupled together and further comprising a plurality of linear bearings 42 coupled between the plates 44 such that the linear bearings 42 between the plates 44 of the clasp 36, together with the linear bearings 42 between the plates of the arm 30 engage the shaft 32 while the clasp 36 is in the closed position, thereby maintaining the shaft 32 in position within the bracket 34 while allowing the shaft 32 to rotate freely in response to a user rotating a reel 50 supported on the shaft 32. This description of bracket 34 is not intended to be limiting. Bracket 34 may be configured in any manner known by a person of skill in the art suitable for securing a shaft while allowing rotation of the shaft.

Figure 20:
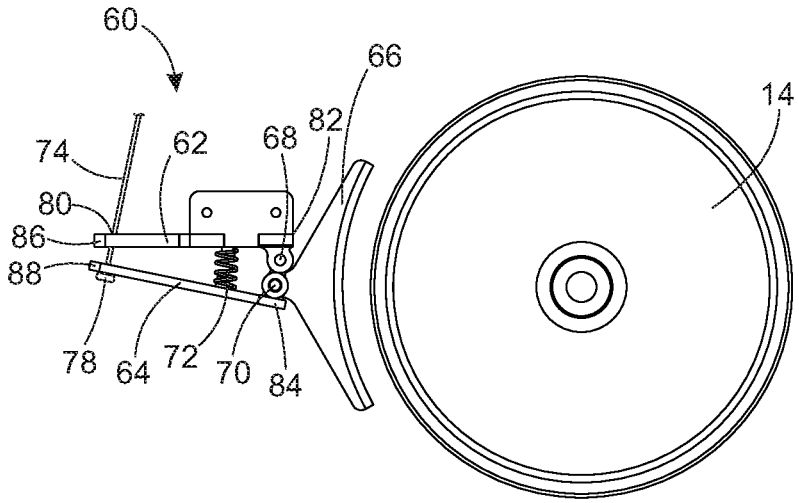
FIG. 20 is a side view of a wheel and a brake mechanism in a disengaged position in accordance with an embodiment.
Figure 21:
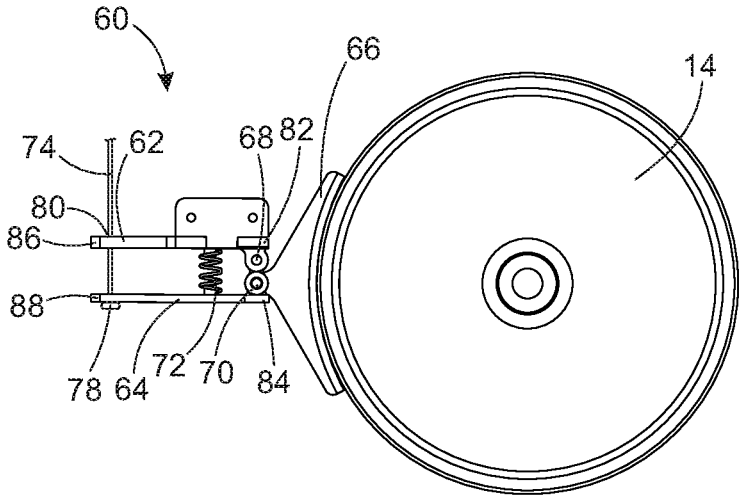
FIG. 21 is a side view of a wheel and a brake mechanism in an engaged position in accordance with an embodiment.
Figure 22:
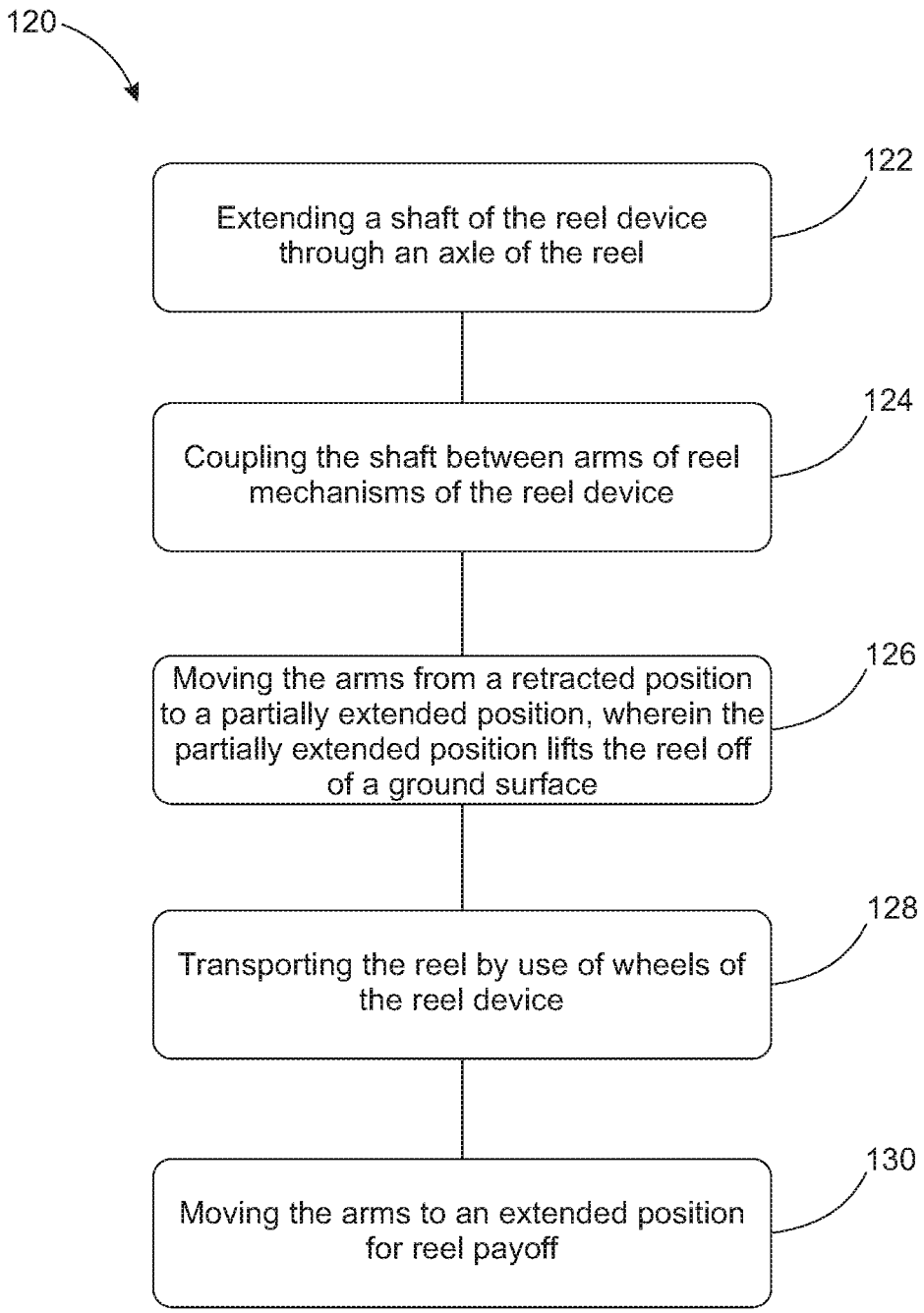
FIG. 22 is a block diagram of a method of use of a reel device in accordance with an embodiment.

In embodiments, the reel device 10 may comprise a brake mechanism 60 housed within the wheel housing 12, as shown in FIGS. 20-21. The brake mechanism 60 may comprise an upper plate 62, a lower plate 64, and a brake pad 66, wherein the upper plate 62 is hingedly coupled at a first end 82 thereof to a first end 84 of the lower plate 64 by a first hinge 68, and the brake pad 66 is hingedly coupled to the lower plate 64 by a second hinge 70, the upper plate 62 being fixedly coupled to the interior of the wheel housing 12, such as by mounting bolts, welding, or the like, and the brake pad 66 being configured in an arc shape to engage the perimeter of the wheel 14. The lower plate 64 may thereby rotate about the axis of rotation of the first hinge 68 with respect to the upper plate 62 between an engaged position and a disengaged position, such that the brake pad 66 is biased against the wheel 14 while in the engaged position, as shown in FIG. 21, and separated from the wheel 14 while in a disengaged position, as shown in FIG. 20, wherein the second hinge 70 enables the brake pad 66 to rotatably self-align with the wheel 14 by contacting the wheel when in the engaged position. A spring, such as a coil spring 72, for example, may be disposed between the upper plate 62 and the lower plate 64, such that the force of the spring 72 tends to maintain the lower plate 64 in an engaged position relative to the upper plate 62, such that the brake pad 66 is biased against the wheel 14. Friction between the brake pad 66 and the wheel 14 prevents the wheel from rotating while in the engaged position, as shown in FIG. 21.

The lower plate 64 may be rotated to a disengaged position, as shown in FIG. 20, by a brake cable 74, the lower end 78 of the brake cable 74 being coupled to the second end 88 of the lower plate 64, whereby the brake cable 74 may be drawn through an aperture 80 in the second end 86 of the upper plate 62, as further described below, to rotate the lower plate 64 and thereby disengage the brake pad 66 from the wheel 14.

The brake mechanism 60, as described, is not intended to be limiting. It is understood that brake mechanism 60 may be any of a variety of brake mechanisms known by a person of skill in the art that are suitable for controllably preventing rotation of the wheel.

In embodiments, as shown in FIGS. 12-16, the reel device 10 may further comprise a handle assembly 90 comprising two handle arms 92, each handle arm 92 being coupled to an arm 30, and the handle arms 92 being coupled together by a stiffening cross member 94. The handle assembly 90 may further comprise a handle 91, further comprising an upper handle member 96 and a lower handle member 98 disposed substantially parallel to the upper handle member 96, the upper handle member 96 and the lower handle member 98 being coupled together at the first ends 104 and 108 thereof by a first side member 100 and at the second ends 106 and 110 thereof by a second side member 102. Each of the first and second side members 100 and 102 may be pivotally coupled, at a point between the upper handle member 96 and the lower handle member 98, to a handle arm 92, respectively, such that the handle 91 may be rotated forward or backward by a user by pushing or pulling the upper handle member 96 or the lower handle member 98.

The upper end 76 of the brake cable 74 may be coupled to a side member 100 or 102 of the handle 91, such that rotation of the handle 91 in a forward direction, by a user pushing the upper handle member 96 or pulling the lower handle member 98, disengages the brake pad 66 from the wheel 14, thereby allowing the wheel 14 to rotate freely, and allowing the user to push or pull the reel device 10 as may be desired. Alternatively, the upper end 76 of the brake cable 74 may be coupled to a side member 100 or 102 of the handle 91, such that rotation of the handle 91 in a backward direction, by a user pushing the lower handle member 98 or pulling the upper handle member 96, disengages the brake pad 66 from the wheel 14, thereby allowing the wheel 14 to rotate freely, and allowing the user to push or pull the reel device 10 as may be desired.

In some embodiments, the brake pad 66 is biased against the wheel 14, preventing rotation of the wheel 14, while the reel device 10 is not in use. In such embodiments, the brake pad 66 may be disengaged from the wheel 14 only when a user pushes the upper handle member 96 or pulls the lower handle member 98 to maneuver the reel device 10 for transporting a reel 50. When the user releases the handle 91, the brake pad 66 engages the wheel 14, thereby preventing rotation of the wheel 14.

The reel device 10 may comprise two brake mechanisms 60, each brake mechanism 60 being disposed within a wheel housing 12 on either side of the reel device 10, with corresponding brake cables 74, respectively, such that rotation of the handle 91 by a user causes the two brake cables 74 and corresponding brake mechanisms 60 to operate simultaneously in concert with each other.

The actuators 40 may be hydraulic actuators and/or electromechanical actuators, or any other actuators known by a person of skill in the art now or in the future. For example, some embodiments may comprise electromechanical actuators having an electrically driven hydraulic actuator pump and cylinders and being powered by a rechargeable battery coupled to the reel device. The actuators 40 may be coupled to a controller (not shown) wherein the controller operates the actuators 40 simultaneously to extend and retract to move the arms 30 to the extended position and the retracted position respectively. The reel device 10 may be in a fully extended position or any position between a fully extended position and fully retracted position depending on the needs of the operator. For example, without limitation, the reel device may be in the extended position or partially extended position for transport, in the fully retracted position for storage, or in the fully extended position for payoff. In at least this way, the reel device 10 may be used to store, transport and payoff.

In operation of embodiments, the reel device 10 may receive and retain a reel 50. For example, the shaft 32 may be extended through the axle of the reel 50. After inserting the shaft 32 through the reel axle, the shaft 32 may be coupled between the arms 30 with bracket 34. Once the reel 50 is mounted to the reel device 10, the wheels 14 may be utilized to transport the reel 50. The wheels 14 may be centrally located on the wheel housing 12 allowing an operator to balance the reel 50 easily on the wheels 14 in order to maneuver the reel 50 through a building or other location. The casters 16 and 22 may be used to support the reel device 10 during loading of the reel 50 and to assist in steering and stabilizing of the reel device 10 during transport.

In operation of embodiments, an operator may push or pull the reel device 10 by pushing or pulling the upper handle member 96 or lower handle member 98, respectively, thereby disengaging the brake pads 66 from the wheels 14 and allowing the reel device 10 to be maneuvered. The operator may thereby push the reel device 10 toward a reel 50, the reel 50 having a shaft 32 inserted therethrough, to mount the shaft 32 into the brackets 34. The operator may secure the shaft 32 into the brackets 34 by closing the clasps 36, such that the clasps 36 are locked by the latches 38. The operator may then raise the reel 50 off the ground by extending the actuators 40 with the actuator controller to raise the arms 30. The operator may then push or pull the reel device 10 by pushing or pulling the upper handle member 96 or lower handle member 98, respectively, to maneuver the reel 50. With the reel 50 lifted off the ground, the reel is free to rotate for payoff or pay on.

Embodiments of a reel device, as described herein, are able to be maneuvered and turned by a user with a zero turning radius. Although embodiments of a reel device described herein comprise two wheels 14, two first casters 16, and a second caster 22, this is not intended to be limiting. It is understood that embodiments may comprise any combination of a plurality of wheels and/or casters suitable for supporting and maneuvering a reel device.

An embodiment may also include a method 120 of using a reel device. The method 120 may include the steps of extending a shaft of the reel device through an axle of the reel [Step 122]; coupling the shaft between arms of reel mechanisms of the reel device [Step 124]; moving the arms from a retracted position to a partially extended position, wherein the partially extended position lifts the reel off of a ground surface [Step 126]; transporting the reel by use of wheels of the reel device [Step 128]; and moving the arms to an extended position for reel payoff [Step 130]. The method may include moving the arms to a retracted position for storage. The method may also include operating hydraulic actuators of each reel mechanism simultaneously to move the arms between the retracted and extended positions. The method may further include rotating a handle assembly by pushing an upper handle member or pulling a lower handle member, wherein rotating the handle assembly draws a brake cable to disengage a brake pad from the wheels.

Accordingly, the components defining any reel device 10 may be formed of any of many different types of materials or combinations thereof that can readily be formed into shaped objects provided that the components selected are consistent with the intended operation of a reel device 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any reel device 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, 3D printing, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of use of a reel device, comprising:

extending a shaft of the reel device through an axle of the reel;

coupling the shaft between arms of reel mechanisms of the reel device;

moving the arms from a retracted position to a partially extended position, wherein the partially extended position lifts the reel off of a ground surface, in response to operating hydraulic actuators of each reel mechanism simultaneously;

transporting the reel by use of wheels of the reel device; and moving the arms to an extended position for reel payoff, in response to operating hydraulic actuators of each reel mechanism simultaneously.

2. The method of claim 1, further comprising moving the arms to a retracted position for storage.

3. The method of claim 1, further comprising rotating a handle assembly by pushing an upper handle member or pulling a lower handle member, wherein rotating the handle assembly draws a brake cable to disengage a brake mechanism from the wheels.

4. The method of claim 3, further comprising releasing the handle assembly to engage the brake mechanism with the wheels.

5. The method of claim 1, further comprising adjusting stability of the reel device by adjusting the height of a caster coupled to the reel device.

6. A method of use of a reel device, comprising:

extending a shaft of the reel device through an axle of the reel;

coupling the shaft between arms of reel mechanisms of the reel device;

moving the arms from a retracted position to a partially extended position, wherein the partially extended position lifts the reel off of a ground surface;

rotating a handle assembly by pushing an upper handle member or pulling a lower handle member, wherein rotating the handle assembly draws a brake cable to disengage a brake mechanism from the wheels;

transporting the reel by use of wheels of the reel device; and moving the arms to an extended position for reel payoff.

7. The method of claim 6, further comprising moving the arms to a retracted position for storage.

8. The method of claim 6, further comprising releasing the handle assembly to engage the brake mechanism with the wheels.

* * * * *